United States Patent [19]

Etsion

[11] Patent Number: 4,543,037

[45] Date of Patent: Sep. 24, 1985

[54] ROTARY HIGH-PRESSURE, LOW-CAPACITY PUMP

[75] Inventor: Izhak Etsion, Haifa, Israel

[73] Assignee: Technion Research & Development Foundation Limited, Haifa, Israel

[21] Appl. No.: 571,661

[22] Filed: Jan. 16, 1984

[51] Int. Cl.[4] ..... F01D 1/36

[52] U.S. Cl. ..... 415/90; 415/203

[58] Field of Search ..... 415/90, 203, 206, 219 R

[56] References Cited

U.S. PATENT DOCUMENTS

| | | | |
|---|---|---|---|
| 1,492,846 | 5/1924 | Holweck | 415/90 UX |
| 3,123,861 | 3/1964 | Westover | 415/90 X |
| 3,617,148 | 11/1971 | Endress | 415/90 |
| 3,794,447 | 2/1974 | Bullough | 415/90 X |
| 3,794,449 | 2/1974 | Brouwer | 415/90 |

*Primary Examiner*—Robert E. Garrett
*Assistant Examiner*—Joseph M. Pitko
*Attorney, Agent, or Firm*—Browdy and Neimark

[57] ABSTRACT

A high-pressure, low-capacity pump comprises a rotor (3) of a smooth, planar, circular surface rotating in a pump casing (1) provided with a stator surface (21) facing the rotor surface at a short distance. The stator surface (21) is in the shape of a circular, flat-topped ridge having its center displaced in respect of the rotor center by a given distance. The circular ridge is characterized by that it is bisected along a line extending through both the center of the circle and the rotor center and that it is of different height on both sides of the bisecting line, creating a respective narrow gap (h) and a wide gap (H) between the ridge and the rotor surface. A fluid inlet (11) is provided in the casing on the outside of the circular ridge and a fluid outlet (22) on the inside of the ridge. Owing to the eccentricity of the rotor and the stator ridge more fluid is drawn by the drag of the rotor surface into the space defined by the stator ridge through the wide gap than escapes through the narrow gap, whereby the pressure increases inside the stator space and drives the fluid out through the fluid outlet.

7 Claims, 5 Drawing Figures

ROTARY HIGH-PRESSURE, LOW-CAPACITY PUMP

Figure 1:
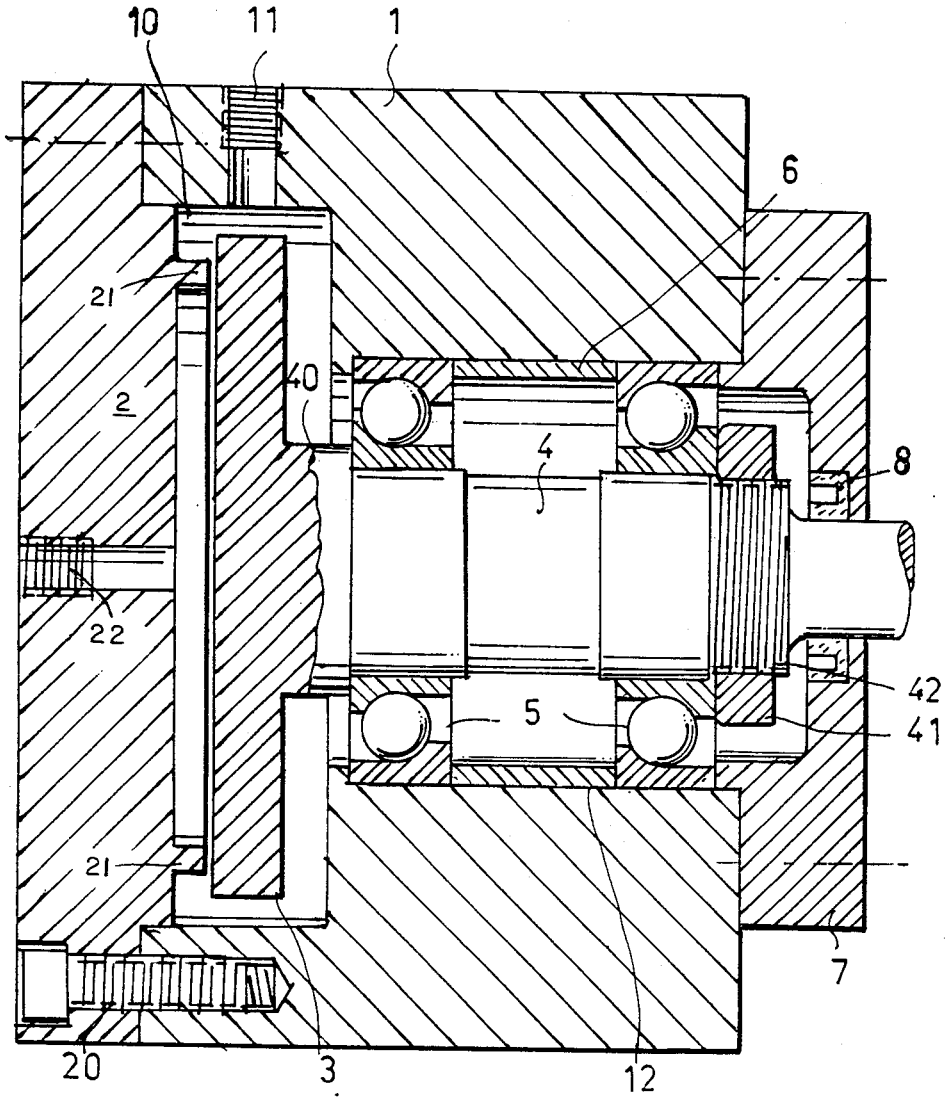

The invention relates to a rotary, high-pressure, low-capacity pump wherein the rotating and the stationary components are in noncontacting relationship.

Pumps designed to pump small liquid volumes to a high pressure are generally of the positive kind, since centrifugal pumps for this type of performance either require very high circumferential velocities, with their inherent cavitation effects, or they are necessarily multi-stage pumps which are costly, difficult to clean and prone to breakdown. Positive pumps for high pressures and low pumped throughput are either reciprocating, such as piston, plunger, or diaphragm, pumps, or rotary displacement pumps for which there exist various designs. The main drawbacks of reciprocating pumps are the requirement for inlet and outlet valves and the wear and tear of the moving parts in rubbing contact. Displacement pumps, on the other hand, usually operate without the need of valves, but leakage between the high-pressure and the low-pressure regions is usually high and makes them unsuitable for high pressure differentials.

A drawback common to all pumps having moving parts with contacting surfaces is the danger of abraded particles entering the fluid stream; this must be avoided in all pumps used in surgery, such as blood pumps, and in those chemical laboratories and plants, and in the food industry, where purity of the products must be maintained.

It is, therefore, the main object of the present invention to provide a medium- and high-pressure pump of relatively small capacity wherein the rotating and stationary parts are in non-contacting relationship. It is another, not less important object that this pump be of simple design and low cost. It is yet another object to make such a pump readily dismantlable and cleanable.

The pump, according to the invention, consists of a stationary casing having a first and a second port, these ports respectively serving as fluid inlet and fluid outlet. A rotor is rotatably positioned in the casing and has one smooth, preferably planar, surface which faces a stator surface integral with the casing, the said two surfaces being separated by a small gap of at least two magnitudes of width.

The stator surface features a flat-topped ridge raised above the generally flat surrounding portion of the stator, the ridge being in the shape of a closed curve which encloses one of the two ports, the second port being positioned in the casing on the outside of the ridge. In the following the expression "inside" is used to denote the area and the volume between the rotor and the stator enclosed by the rim, while the expression "outside" will denote all other parts of the casing except for the said "inside".

When the rotor rotates at a predetermined speed of revolution, its surface passes each point of the stator ridge at a velocity proportional to the distance of the point in question from the centre of rotation of the rotor, and it crosses the ridge from the outside to the inside—or vice versa—at an angle determined by the shape of the curve. The curve, according to the invention, is shaped in such a manner that a tangent to any point of the curve forms an acute, positive or negative, angle with the velocity vector of the rotor passing through this point. In order to obtain a fluid flow under pressure from the inside to the outside of the ridge, the gap between the top of the ridge and ridge and the rotor surface is of a minimum, width at all points of the curve at which the rotor velocity vector extends from the outside towards the inside, whereas the gap is of a predetermined larger width at all points of the curve at which the rotor velocity vector extends from the inside towards the outside.

By reversing the sense of rotation of the rotor a fluid flow of identical pressure and volume conditions is obtained from the outside to the inside of the ridge, i.e. fluid is sucked into the pump through the port outside the ridge and expelled through the port inside the ridge simulating a centripetal effect.

The invention is based on the following principle: A fluid in a gap, of width h, between a stationary and a moving surface is dragged by the moving surface in the direction of the velocity vector, v; the fluid flow, $Q_1$, per unit length being expressed by the equation $$Q_1 = v \cdot h/2. \tag{1}$$

When the moving surface progresses from a low-pressure to a high-pressure zone ($P_2$ and $P_1$ respectively), there is also a pressure induced flow, $Q_2$, in the opposite direction, and this is expressed by the equation $$Q_2 = (h^3/12 \cdot \mu) \cdot (P_1 - P_2)/L \tag{2}$$

L being the length of the gap in the direction from high to low pressure, and $\mu$—the viscosity of the fluid.

Presuming that the pump of the invention is to act as a suction pump, i.e. fluid is to be pumped from the outside to the inside of the curve defined by the flat-topped ridge against a pressure differential, then more fluid must be moved across the ridge for its entire length to the inside by the moving rotor than is flowing across rhe ridge to the outside owing to the pressure difference. At every point of the curve these conditions are expressed by the equation $$Q_1 - Q_2 = Q_T = v \cdot h/2 - h^3 \cdot (P_1 - P_2)/12 \cdot \mu \cdot L. \tag{3}$$

It is evident that at all points at which the vector, v, is directed from the high-pressure inside to the low-pressure outside, the two members of the equation add up to a total outward flow. In order to reduce this outward flow to a minimum, the gap width at all these points is kept to a mechanically feasible minimum, for instance h=0.01 mm. On the other hand, at all points at which the vector, v, is directed from the outside to the inside of the ridge, the difference between the first and the second member is positive since the inflow, represented by the first member, is larger than the outflow represented by the second member, if fluid is to be pumped against the high pressure side. This is attained by making the gap, H, at these points wider than the minumum gap. From equation (3) it becomes evident that the velocity vector, v, must be sufficiently large, a postulate which defines the necessary rotor speed, which must increase in direct proportion to the pressure differential, all other factors remaining constant.

Figure 2:
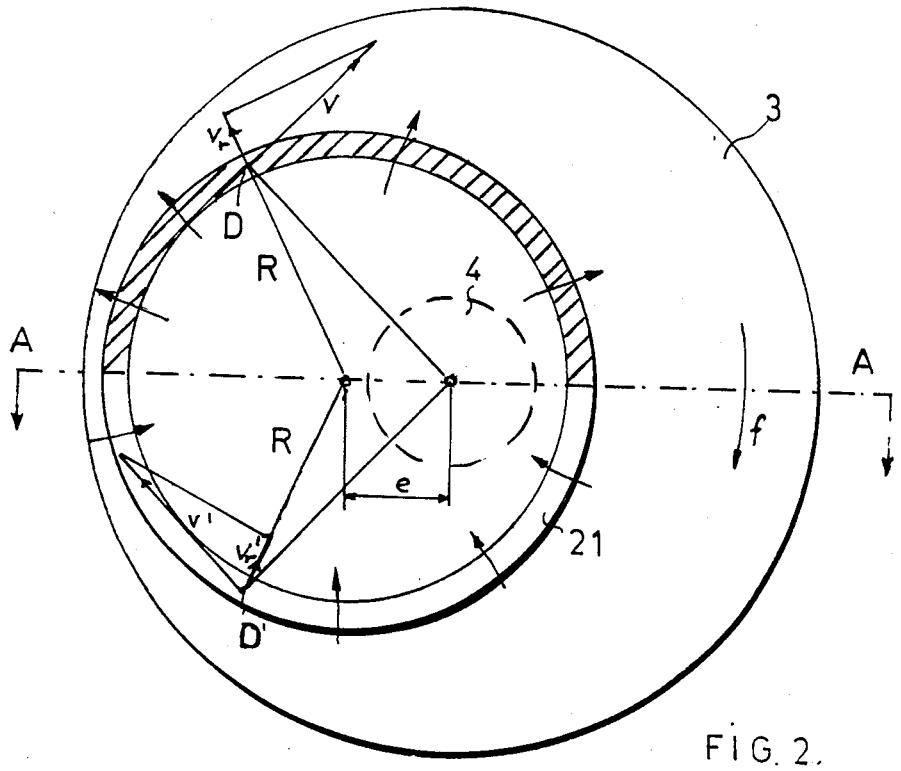
Figure 3:
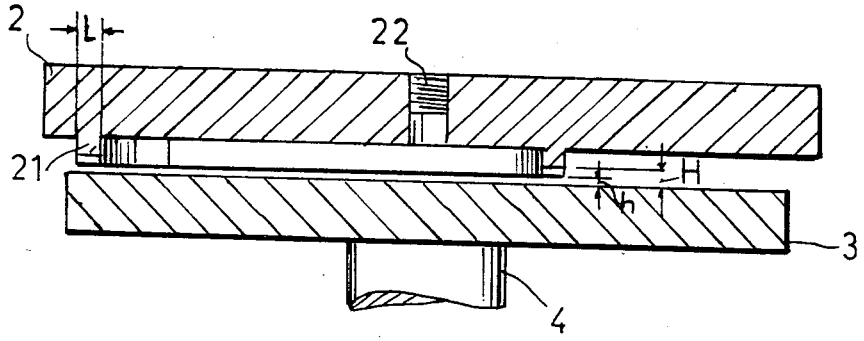
Figure 4:
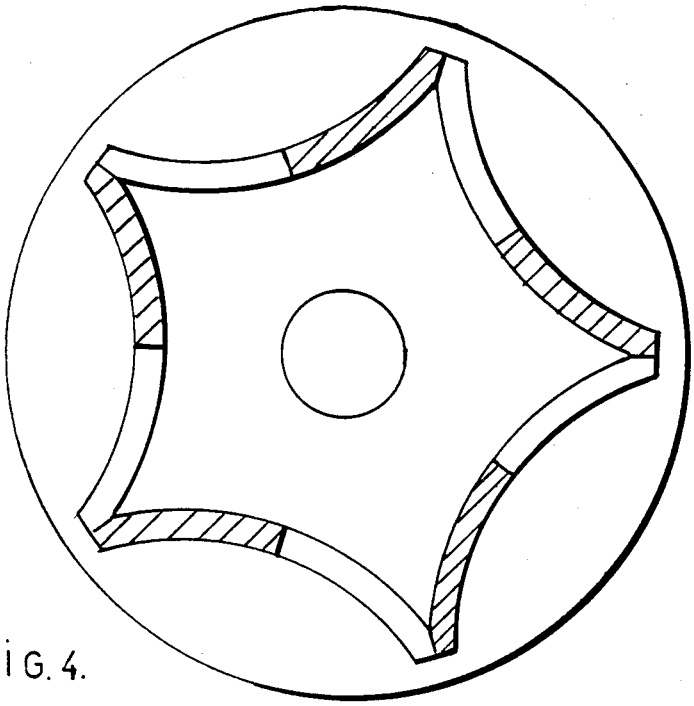
Figure 5:
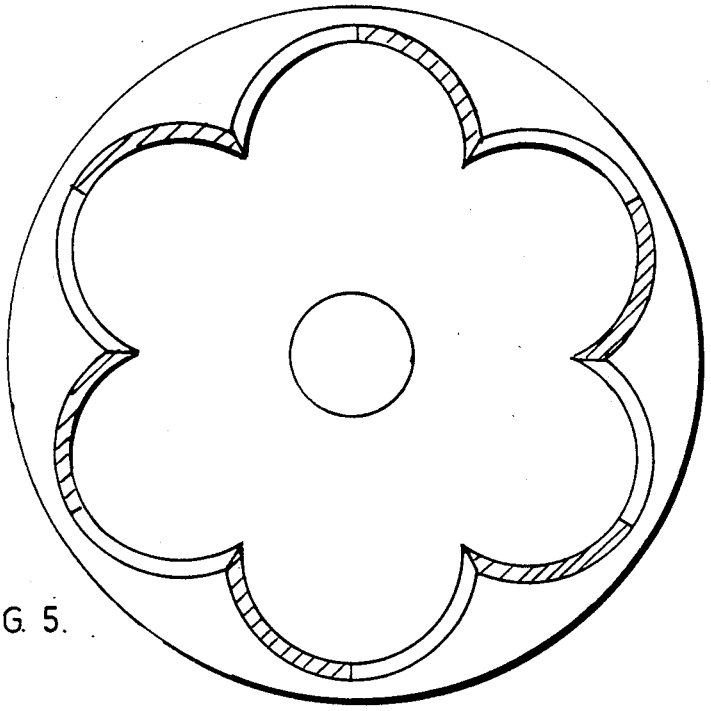

Further objects and advantages of the invention will appear from the following description, taken together with the accompanying drawings, wherein FIG. 1 is a section through a centripetal pump, FIG. 2 represents a diagram illustrating the flow geometry between rotor and stator, FIG. 3 is a section along A—A of FIG. 2, FIG. 4 is a plan view of a stator ridge in the shape of an axisymmetrical curve with five points, and FIG. 5 is a plan view of a stator ridge in the shape of an axisymmetrical curve with six lobes.

The pump illustrated in FIG. 1 comprises a pump casing 1, closed by a front cover 2, a rotor 3 integral with a shaft 4, and two ball bearings 5 supporting the rotor shaft in the casing. The casing is provided with a cylindrical cavity 10 and with an inlet port 11 entering the cavity from the outside. The rear of the casing is machined to form a second cylindrical cavity 12 accommodating the two ball bearings 5 which are separated from each other by a bush 6. A rear cover 7 encloses the space of the ball bearings and is provided with an oil retainer 8 around the shaft end. The inside of the front cover facing the rotor is so shaped as to form a circular stator surface in the shape of a raised ridge 21 which is eccentric in relation to the shaft centre and will be more fully described with reference to FIGS. 2 and 3. The rest of the front cover is substantially flat and tightly connected to the casing by a number of bolts 20; the cover centre is drilled and tapped and forms an outlet port 22.

The rotor 3 is in the shape of a planar disc having a smooth frontal surface distanced from the stator 21 by a small gap. The rotor forms the front portion of the shaft 4 which is machined so as to permit the two ball bearing to be mounted. The latter are tightened against a shoulder 40 on the shaft by means of a flat nut 41 mounted on a screw-threaded portion 42 of the shaft. The rear end of the shaft (cut off in the drawing) is connected to an electric motor by coupling means or by a belt drive. Rotation of the rotor forces liquid into the space surrounded by the raised ridge, whereby the liquid is sucked into the pump through the inlet port 11 and driven out through the outlet port, 22.

The actual working of the pump will now be demostrated with reference to FIGS. 2 and 3. A rotor 3 is fastened to a machine shaft 4 and rotates clockwise (as indicated by the arrow f); it is separated from a stator 21 by a gap, of width h for one half of its circumference and of width H for the other half. The stator 21 is in the shape of an annular surface of median radius R and breadth L. The stator centre is eccentric to the rotor centre by a distance e, the centres of the rotor and of the stator lying on a bisector line A—A. Viewing the upper half of FIG. 2, i.e. the portion above the bisector A—A, and especially point D on the stator, it becomes apparent that each point of the rotor at a radius R has a velocity v from the inside to the outside of the stator surface. As a result the fluid in the gap is moved across the breadth of the stator at velocity $V_r$, $v_r$ being the component of the velocity v in the direction of the stator radius R.

It is also apparent that at every point in the upper half, above the bisector, there is an outwardly directed velocity vector which decreases to zero as it approaches the bisector line. It is likewise evident from the portion of the diagram containing point D' (below the bisector) that, at every point of the rotor, in the lower half, the velocity vector v' is inwardly directed, viz. from the outside towards the inside of the stator surface. By making the gap H on the side above the bisector larger than the gap h below the bisector, a larger fluid volume is moved outwardly than inwardly at every two corresponding points positioned symmetrically with respect to both sides of the bisector. This can be shown analytically to be so by consulting equation (1), the net outward flow at two symmetrical points induced by the rotor velocity being $$dQ_s = dQ_1 - dQ_1' = 2\cdot\pi\cdot dR\cdot v/2\cdot(H-h) = \pi\cdot dR\cdot v\cdot(H-h) \quad (3)$$

or integrated for the entire circumference of the stator $$Q_s = w\cdot e\cdot R\cdot(H-h). \quad (4)$$

wherein w—rotational rotor speed.

In the present case the fluid is to be pumped from inside the raised rim at a pressure $P_2$ to the outside at a pressure $P_1$. At standstill the pressure differential would result in a fluid inflow through the gaps H and h, as expressed by equation (2):

$$Q_p = \pi\cdot R\cdot(H^3+h^3)\cdot(P_1-P_2)/12\cdot\mu\cdot L. \quad (5)$$

The total outflow is therefore:

$$Q_t = Q_s - Q_p = w\cdot e\cdot R(H-h) - \pi\cdot R\cdot(H^3+h^3)\cdot(P_1-P_2)/12\cdot\mu\cdot L. \quad (6)$$

In order to obtain the required pump output $Q_t$ for a given pressure head $(P_1-P_2)$, the value of the variable components must be chosen accordingly. On scrutinizing equation (6) it becomes apparent that the gaps H and h must be very small, as small in fact, as technically possible, but that their difference (H−h) should be comparatively large. The radius of the stator ridge R should be as large as the rotor diameter permits, and so should be the distance e between the rotor and stator centres.

The equation also shows that the width of the ridge L, should be made large, but not too large, so as to keep hydraulic friction losses to a minimum. And lastly, the pumped volume $Q_t$ increases in direct proportion with the rotor speed, so that for a required high pressure differential the pump revolutions must be proportionally high.

The foregoing description refers to only one embodiment of the invention, viz. to a smooth-surfaced rotor and to a stator surface in the shape of a closed curve. The same result will, however, be obtained by exchanging the tasks of the rotating and the stationary parts, since the effect here described is due to the relative velocities of stator and rotor. In the alternative construction, therefore, the stator will have a smooth, plane surface, while the rotor is provided with a raised, closed ridge.

From the foregoing description and diagram it becomes selfevident that by reversing the sense of rotation, the high-pressure zone will be inside the stator ridge, while the low-pressure zone will be outside the stator ridge. Accordingly fluid will be sucked into the pump through port 11 and delivered to the outside through port 22 (v. FIG. 1).

In the foregoing only one configuration of the stator surface has been described, but it will be understood that many other kinds of curves may be employed for the same purpose, the condition, in accordance with the invention, being that there are alternative stretches in which the velocity vectors are respectively directed towards the outside and the inside of the curve. The curve must not necessarily be symmetrical, neither with regard to the rotor axis, but it is selfevident that a symmetrical curve loads the rotor symmetrically, which is advantageous for the balance of the rotating parts. Examples of such curves are shown in FIGS. 4 and 5.

Instead of providing uniform gap widths, H and h, along a complete arc of the closed curve, the width may gradually increase and decrease in accordance with the changes in the vector component $v_r$ (FIG. 2).

I claim:

1. A rotary hydraulic pump adapted to convey a fluid from a low-pressure zone into a high-pressure zone, comprising a stationary casing provided with a first fluid port in said high-pressure zone and with a second fluid port in said low-pressure zone; a rotor rotatable about an axis in said casing and having a smooth and uniform surface; a stator connected to said casing and having a major surface facing said rotor surface; the pump being characterized by said stator surface being separated from said rotor smooth surface by at least two gap widths, said stator including a ridge protruding in the direction of said axis from the major surface of said stator, said ridge defining a closed curve separating said high-pressure zone from said low-pressure zone, said curve being so formed that a tangent to every point of said closed curve forms an acute, positive or negative, angle with the relative velocity vector of said rotor surface passing through that point, or coincides with said curve, and that at all points of said curve where the relative velocity vector of said rotor surface is directed from the zone of high pressure to the zone of low pressure, the width of the gap between said opposing surfaces is smaller than it is at those points where the velocity vector is directed from the zone of low pressure to the zone of high pressure.

2. The pump of claim 1, wherein the surface of said rotor is circular and planar.

3. The pump of claim 1, wherein said ridge is in the shape of a circular curve of uniform breadth, the centre of said circle being positioned at a distance from said rotor axis, said stator surface being distanced from said rotor surface by a narrow gap of width h at all points lying on one side of an imaginary line drawn through the centres of said rotor and said circle, and by a wider gap of width H, at all points lying on the other side of said imaginary line.

4. The pump of claim 1, wherein the rotor is in the shape of a flat disc.

5. The pump of claim 4, wherein said rotor is integral with the pump shaft.

6. The pump of claim 4, wherein said stationary casing is provided with a cavity enclosing said rotor disc, and with a flat cover serving to close said cavity, the inside of said cover being shaped to form said ridge.

7. The pump of claim 1, wherein said stator surface is in the shape of an axisymmetrical curve with a plurality of outwardly projecting lobes.

* * * * *